United States Patent [19]

Spencer

[11] 4,078,835

[45] Mar. 14, 1978

[54] FIRM CLOSURE AND LOCKING DEVICE FOR VENT WINDOWS

[76] Inventor: Woodford C. Spencer, 5701 Kettering Square Dr., S., Kettering, Ohio 45440

[21] Appl. No.: 714,044

[22] Filed: Aug. 13, 1976

[51] Int. Cl.[2] ..... E05C 19/18

[52] U.S. Cl. ..... 292/206; 292/258

[58] Field of Search ..... 292/DIG. 6, 64, 212, 292/288, 258, 202, 206

[56] References Cited

U.S. PATENT DOCUMENTS

| | | | |
|---|---|---|---|
| 548,931 | 10/1895 | Schwarnueber | 292/212 X |
| 1,015,082 | 1/1912 | Rousseau | 292/212 |
| 2,151,934 | 3/1939 | Parrott | 292/337 |
| 2,202,393 | 5/1940 | Morrison | 292/DIG. 6 |
| 3,722,935 | 3/1973 | Latib | 292/DIG. 6 |
| 3,938,839 | 2/1976 | Collier | 292/DIG. 6 |

*Primary Examiner*—Richard E. Moore
*Attorney, Agent, or Firm*—Melvin Wiviott

[57] ABSTRACT

A firm closure and locking device to firmly close and lock a vent window pivotally mounted and adjacent to a rigid member. The device has a body portion configured in a U-shape which fits over the edge of the vent window adjacent to the rigid member. A locking arm is pivotally mounted to the body onto a pivot element, preferably a screw-like member projecting from the body. A pressure-bearing device, such as a handle with an internal threaded receptacle portion is threadedly engaged onto the screw-like member. The handle is rotated upon the screw-like member to advance it inwards towards the body, thereby applying pressure against the locking arm intermediate the handle and the body of the locking device. When the U-shaped portion of the body is fitted over the edge of the vent window adjacent the rigid member and no pressure is applied against the locking arm, the locking arm is free to rotate about the screw-like member until it abuts against the side of the adjacent rigid member. Pressure applied against the locking arm by the rotating handle locks the locking arm against further pivotal rotation and furthermore draws the vent window into a tightly closed position preventing air seepage and wind noise.

5 Claims, 10 Drawing Figures

FIRM CLOSURE AND LOCKING DEVICE FOR VENT WINDOWS

FIELD OF INVENTION

This invention relates to a firm closure and locking device used to prevent air seepage and wind noise around the edges of vent type windows as well as securely locking these windows in place.

BACKGROUND OF INVENTION

The vent window has for many years been commonly used in automobiles as well as in various types of building construction. This type of window is affixed to a pivot element and is opened and closed by rotation about a pivot mount. The opening and closing can be accomplished by a handle on the interior of a car or building which is cranked around to rotate the pivot element thereby swinging the window affixed to it into an open or closed position. Another type of vent window has no crank handle, but is swung open and closed around the pivot mount by manually pulling or pushing that window into the position desired. The vent window is normally held closed by a conventional type catch.

By the very nature of the pivotally mounted vent window having a conventional type catch, it is normally still possible to spring this window outwardly a sufficient amount about its pivot mounting to allow a small space for inserting a wire or thin hook between the window edge and the window frame and/or rubber gasket around that frame. This hook or wire in many instances can be used to engage a car door lock knob protruding upwards on the inside of the car door. The lock knob is then pulled into an open position allowing the car door to be opened. It is also possible on a vent window having no crank handle to use the hook or wire to pull up on the window catch lever thereby releasing the catch and permitting the window to be opened by manually pushing against it. This then allows the individual trying to enter the car to insert his hand into the car through the open vent window and release the door lock.

In the past, various types of locking devices have been developed in an attempt to securely lock the vent window of an automobile. One method was to drill a hole through the window and insert a pin through the hole and into a pin holding device on the door frame. It is obvious that this method has disadvantages. A skilled worker is required to drill a hole through the glass as well as mount the pin holding device on the door. There is also the obvious possibility of window breakage.

Another method was to insert a thin metal plate with barbs on it into the rubber molding on the vent window sill. On the plate is mounted an arm which can rotate on a pivot to abut an adjacent window or window post. It is obvious that if there is no rubber molding or penetrable material on the bottom of the vent window, the barbs cannot be inserted and this locking device can't be used. Also pressure on the vent window can possibly dislodge or move the barbs in the relatively soft molding thereby permitting the opening of the window. This type of lock, by its very nature, is restrictive in its use to a location in a lower corner of the vent window.

Complex channels and bolt like locks and catches have also been developed in the past. These have been restrictive in that they may not have flexibility in adjusting to various door or window thickness, have to be located only in a lower corner portion of the vent window, depend on barbs inbedded in soft material for holding strength, or require entire channels across a window frame edge in order to work.

Another problem previous types of locks did not address was how to draw the vent window closed and sufficiently tightened in that closed position for purposes of not only locking the window, but also to exert enough pressure thereon to prevent seepage of air into the car around the edges of that window with its accompanying wind noise when the car is moving.

SUMMARY OF INVENTION

To avoid the problems discussed above, it is desirable to provide a unique type of vent window firm closure and locking device which is effective, simple, virtually tamper proof and having great flexibility of use.

A feature of the subject invention is to provide a vent window lock requiring no mechanical work or changes to be made to the vent window itself or its surrounding frame or other structural members in order to use the subject invention.

Another feature of this invention is its unrestricted use and placement anywhere along an edge portion of a vent window which is adjacent to a rigid member.

Still another feature of this invention is to have a locking arm rotate with the additional capability of inward and outward movement of this arm to avoid hitting an adjacent rigid member of varying thickness as the locking arm is being rotated.

An additional feature of this invention is the use of a pressure bearing device to both lock the locking arm of the vent window lock securely in place as well as drawing the vent window into a closure tight enough to prevent wind seepage and its accompanying noise.

Another feature of this invention is to have a vent window lock which can easily be operated with one hand and to have a locking arm exactly aligned in the locked and unlocked position by "positive stops."

A further feature of this invention is to provide a vent window firm closure and locking device that is compact, light weight and easy to use.

Other features and advantages of the invention will be apparent from the following description taken in conjunction with the accompanying drawings wherein.

Figure 1:
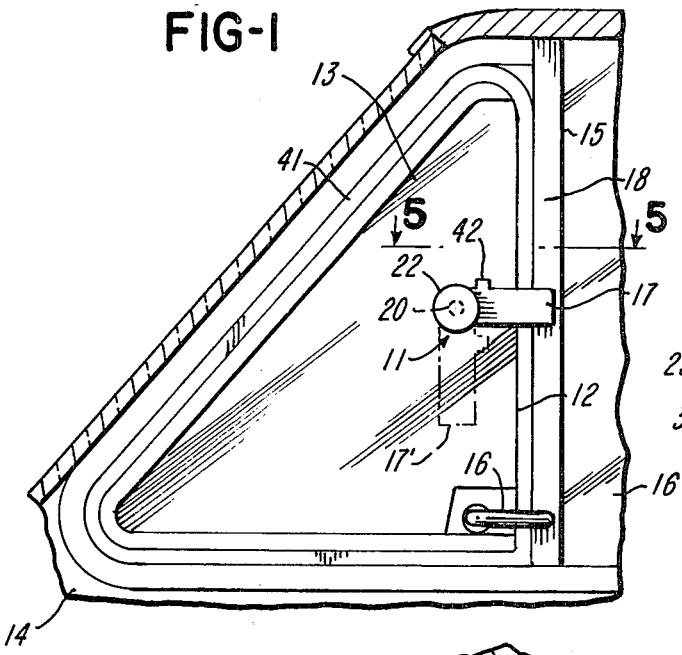
FIG. 1 is a side plan view of the device mounted on the vent window of a vehicle as viewed from inside that vehicle.

With reference to FIG. 1, a firm closure and locking device 11 is shown affixed to the trailing edge portion 12 of a vent window 13 of a vehicle 14. The trailing edge portion 12 is adjacent to window frame bar 15 which separates vent window 13 from side window 16. The vent window 13 and side window 16 are both shown in a closed position. A conventional type catch 16 is shown on vent window 13. The firm closure and locking device 11 is shown in a locking configuration whereby locking arm 17 of device 11 is in abutment against the side portion 18 of window frame bar 15. The firm closure and locking device 11 is in an open position when the locking arm 17 is rotated out of abutment with window bar 15 and is in a configuration as shown by locking arm 17.

Figure 2:
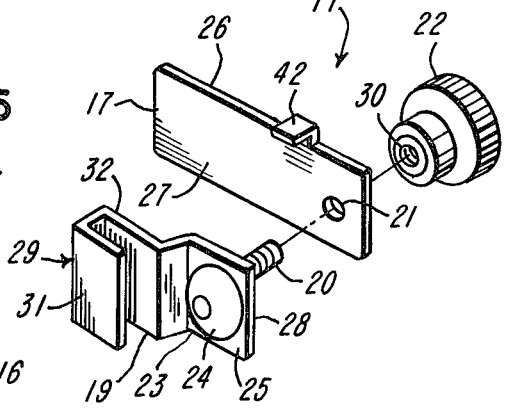
FIG. 2 is an exploded isometric view of the device.

The firm closure and locking device with its component parts portrayed in an exploded isometric view is shown by FIG. 2. The locking arm 17 is affixed to body 19 by means of bolt 20 projecting from body 19 and going through hole 21 within that locking arm. The locking arm 17 is held onto the body 19 by a handle 22 which has internal threads 30 therein compatible to the external threads of the projecting bolt 20. The handle 22 is screwed onto projecting bolt 20 and prevents the locking arm 17 intermediate the body 19 and the handle 22 from falling off. When the handle 22 is rotated about bolt 20 in a first direction, the handle 22 approaches the outer surface of offset portion 23 of body 19. When the handle 22 is sufficiently rotated in that first direction to tighten it against locking arm 17, the locking arm 17 is held firmly against offset portion 23. Locking arm 17 is locked into position and prevented from movement by the pressure exerted upon it on one side by pressure bearing handle 22 and on the other side by the pressure exerted upon it by the outer surface 28 of offset portion 23. The head 24 of bolt 20 is positioned against the inner surface 25 of offset portion 23. As handle 22 is rotated in the first direction about bolt 20 and applies pressure against top surface 26 of locking arm 17, an equal and opposite reaction pressure is exerted by the head 24 of the bolt 20 against the inner surface 25 of offset portion 23. The pressure by bolt head 24 against inner surface 25 of the offset portion 23 causes the outer surface 28 of offset portion 23 to apply pressure against the bottom surface 27 of locking arm 17. The combined pressure of the pressure bearing handle 22 on upper surface 26 of locking arm 17 and the pressure exerted by outer surface 28 of offset portion 23 against bottom surface 27 of locking arm 17 firmly draws locking arm 17 against offset portion 23 thereby locking it from movement.

When pressure bearing handle 22 is rotated in a second opposite direction about bolt 20, the handle 22 moves away from bolt head 24 thereby releasing the pressure applied against locking arm 17 and allowing locking arm 17 rotational movement about bolt 20. Locking arm 17 is on the outside of the outer surface 28 of offset portion 23. Consequently, since portion 23 is offset from the rest of body 19 which consists of a U-shaped first end portion 29, the rotating locking arm 17 on the outside of offset portion 23 will be free of interference with the U-shaped first end portion 29.

Figure 3:
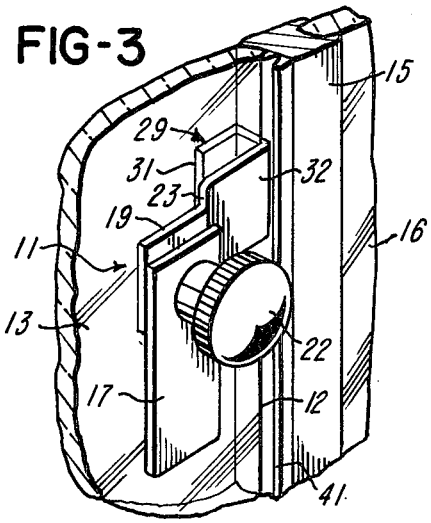
FIG. 3 is a fragmentary isometric view of the device in an open position mounted on a vent window.
Figure 4:
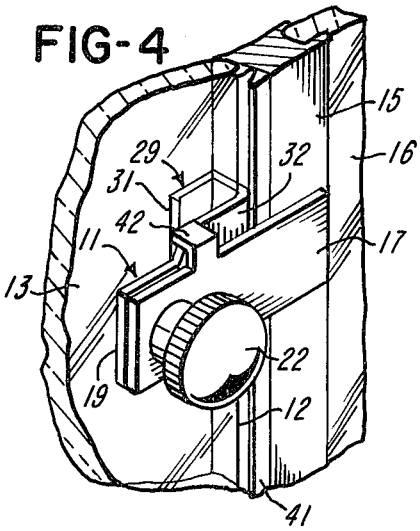
FIG. 4 is a fragmentary isometric view of the device in a closed position mounted on a vent window.

FIGS. 3 and 4 show in detail the firm closure and locking device 11 in both open and closed positions, respectively, when in actual use. The U-shaped first end portion 29 circumscribes the trailing edge portion 12 of vent window 13 which is adjacent window frame bar 15. The U-shaped end portion 29 can be held onto the edge portion 12 of vent window 13 by pressure exerted by sides 31 and 32 of U-shaped end portion 29 configured to fit tightly about edge portion 12 of the vent window 13. A more permanent placement of firm closure and locking device 11 about vent window edge portion 12 can be obtained if an adhesive, such as an epoxy, were placed on the inside of the U-shaped end portion 29 prior to placing that end portion 29 in a circumscribing position about the edge portion 12 of vent window 13. The body 19 of the firm closure and locking device 11 would then be permanently affixed onto the edge portion 12 of vent window 13. In FIG. 3 the locking arm 17 has been rotated away from window frame bar 15 and is hanging in a downward position. Since locking arm 17 is not in abutment with window frame bar 15, vent window 13 is free to move into either an open or closed position.

In FIG. 4, the locking arm 17 is shown in abutment with window frame bar 15 and is held in that position by pressure applied against locking arm 17 by handle 22. Since the trailing edge portion 12 of vent window 13 is encompassed by and held by U-shaped end portion 29 and that end portion in turn is a part of body 19 which is held tightly against locking arm 17 by pressure from pressure bearing handle 22, vent window 13 cannot move outwards to open if locking arm 17 is held in a firm position of abutment with window frame bar 15. It is obvious that when locking arm 17 is held in abutment against window bar frame 15, the locking arm cannot move and therefore the vent window 13 cannot move since it is held by U-shaped end portion 29 which cannot move with respect to locking arm 17. Therefore the vent window as shown by FIG. 4 is firmly locked into place in a closed position.

Figure 5:
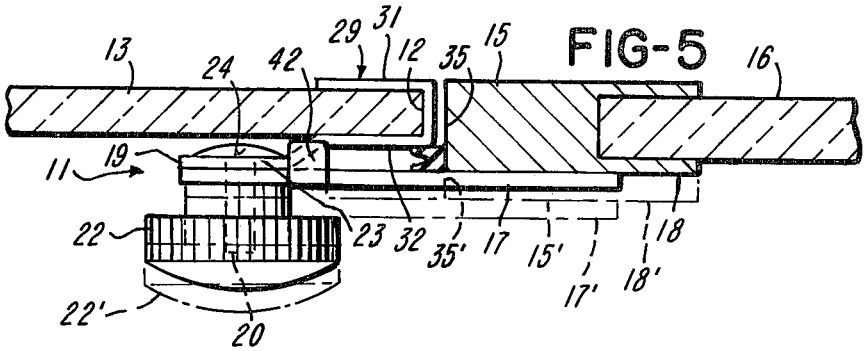
FIG. 5 is a cross sectional view of the device greatly enlarged taken on line 5—5 of FIG. 1 and showing the inward and outward movement of the locking arm.

FIG. 5 shows other features of firm closure and locking device 11. This device has the flexibility of being capable of adjustment to accommodate various thicknesses of different window frame bars 15. The locking arm 17 is capable of moving inwards and outwards from body 19 depending on the distance pressure bearing handle 22 is with respect to body 19. If the window frame bar 15 is of a normal thickness, the offset portion 23 of body 19 permits the locking arm 17 resting on offset portion 23 to have sufficient clearance due to the offset portion to allow locking arm 17 to rotate about bolt 20 and abut the side portion 18 of window frame bar 15' without first hitting the adjacent edge portion 35 of window frame bar 15 and having its rotational movement stopped. If the window frame bar 15 is of a greater thickness, the pressure bearing handle 22' is rotated in a counter clockwise motion to bring that handle away from body 19. As pressure bearing handle 22' moves away from body 19, the locking arm 17' is therefore also allowed to move away from body 19. Thus, locking arm 17' has additional clearance from body 19 and is able to abut side portion 18' of the thicker window frame bar 15' without hitting the adjacent thicker edge portion 35' and having its rotational movement stopped prior to proper abutment. Once locking arm 17' is in proper abutment against side portion 18' of thicker window frame bar 15', the pressure bearing handle 22' is rotated in a clockwise direction about bolt 20 to bring pressure against locking arm 17' to hold it into a securely locked position against abutting side portion 18' of the thicker window frame bar 15'.

Figure 6:
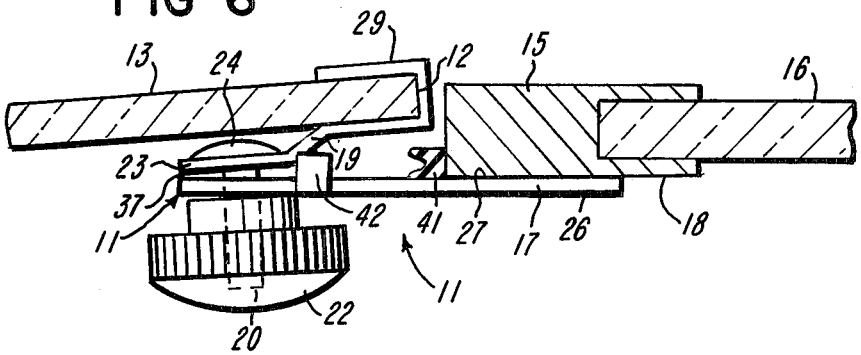
FIG. 6 is a view similar to FIG. 5 showing the device affixed to a vent window in a slightly open position.
Figure 7:
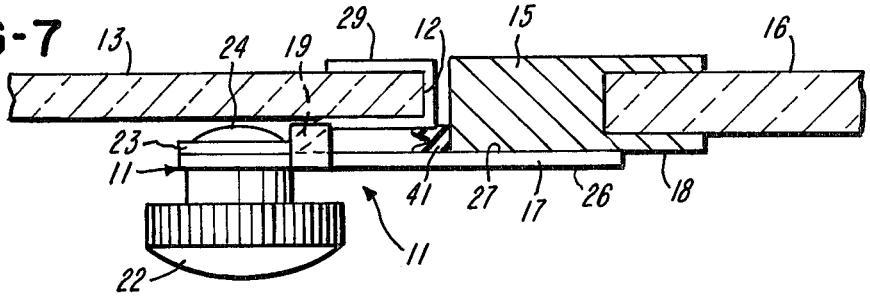
FIG. 7 is a view similar to FIG. 6 showing the device affixed to a vent window drawn into a closed position.

FIGS. 6 and 7 show the embodiment of the subject invention enabling the closure and locking device 11 to firmly draw vent window 13 into a tightly closed position before securely locking it in place. As can be seen by FIG. 6, the vent window 13 may be slightly offset from being perfectly aligned in a closed position against gasket 41 of the window frame. As shown by FIG. 6, U-shaped first end portion 29 circumscribes and is affixed to the trailing edge portion 12 of vent window 13. The locking arm 17 is askew with respect to offset portion 23 and in abutment with the side portion 18 of window frame 15. As the handle 22 is rotated in a clockwise direction, it approaches the head 24 of bolt 20. As handle 22 gets closer and closer to the head 24 of bolt 20, it exerts more and more pressure against surface 26 of locking arm 17. This pressure is transmitted by locking arm 17 against the side portion 18 of window frame bar 15. Since the window frame bar 15 is rigid and cannot move, the not result is that as surface 27 of locking arm 17 pushes against side portion 18 of window frame bar 15, pressure is simultaneously exerted by surface 27 against the offset portion 23 of body 19. The pressure exerted by locking arm 17 simultaneously against window frame bar 15 and offset portion 23 causes handle 22 to pull against bolt 20 and thereby draw this bolt 20 towards the handle 22. The head 24 of bolt 20 is, consequently, also drawn towards handle 22. Since head 24 is in abutment with the offset portion 23, the head 24 pushes this offset portion 23 towards locking arm 17. The offset portion 23 being physically attached to the U-shaped first end portion 29 causes that U-shaped end portion to move towards locking arm 17 and thereby to rotate around contact surface 37 where locking arm 17 and offset portion 23 abut each other. Since U-shaped end portion 29 is affixed to vent window 13; as U-shaped end portion 29 is drawn towards locking arm 17 and therefore towards gasket 41, affixed vent window 13 is also drawn towards that gasket.

FIG. 7 shows vent window 13 when completely drawn closed against gasket 41. The pressure exerted by handle 22 against locking arm 17 has forced that locking arm into substantially full abutment against the flat surface of offset portion 23 of body 19. Surface 27 of locking arm 17 is also in substantially complete abutment against the flat surface of side portion 18 of window frame bar 15. The configuration described results in the U-shaped end portion 29 being drawn towards window gasket 41 as the surfaces immediately mentioned are forced into abutment. Consequently, vent window 13 affixed to U-shaped end portion 29 is also drawn towards and into a tightly closed position against window gasket 41.

Figure 8:
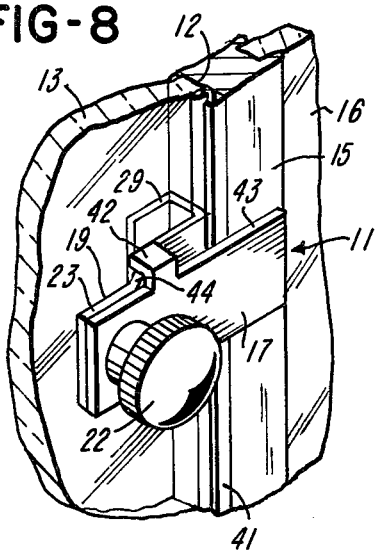
FIG. 8 is a fragmentary isometric view of the device showing the lip like portion on the locking arm in a positive stop position holding the locking arm in abutment with the window frame bar.

Another embodiment of the subject invention is shown by FIG. 8. The locking arm 17 has a lip like portion 42 that curves and protrudes away from its top edge portion 43. As locking arm 17 is rotated clockwise, the lip like portion 42 hits the top edge portion 44 of body 19 of the firm closure and locking device. The configuration of lip like portion 42 in conjunction with the configuration of body 19 is such that when lip like portion 42 is in abutment with the top edge portion 44 of body 19, a "positive stop" is obtained to the clockwise rotational movement of locking arm 17. At this "positive stop" position, locking arm 17 is aligned in full abutment with window frame bar 15. The locking arm 17 is further kept from movement and held in this full abutment position by pressure bearing handle 22 applying pressure against that locking arm.

Figure 9:
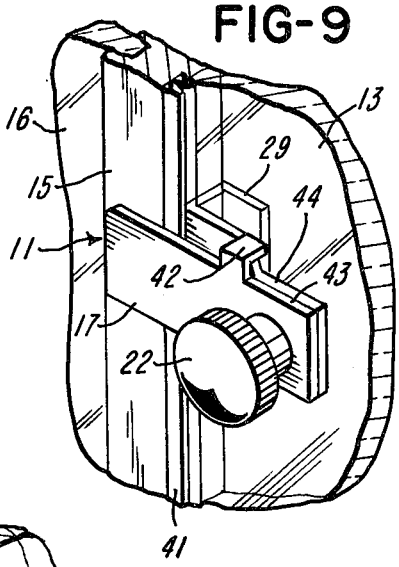
FIG. 9 is a view similar to FIG. 8 showing the configuration of the device on a vent window on the opposite side of the vehicle than the vent window shown by FIG. 8.

FIG. 9 is similar to FIG. 8 but has a significant difference. The lip like portion 42 is curved and protrudes away from the top edge portion 43 of locking arm 17 in a direction opposite to that shown by FIG. 8. This difference is necessitated to allow the firm closure and locking device 11 to be used for both the left front vent window and right front vent window of an automobile. It is obvious that in order for the locking arm 17 to be rotated into full abutment with window frame bar 15 and held in a "positive stop" position, the locking arm 17 must be chosen with the correct curvature of lip like portion 42 dependent upon whether it is to be used on a right front or left front vent window.

Figure 10:
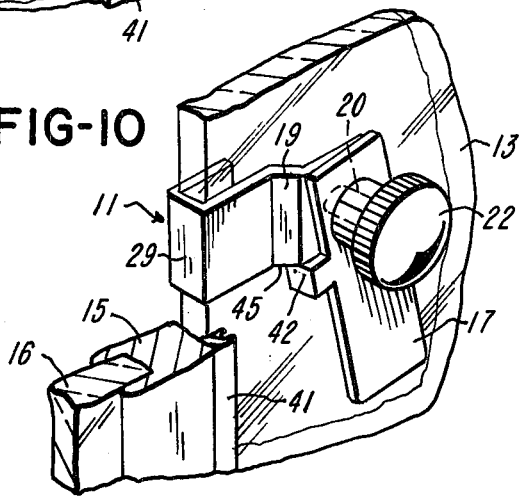
FIG. 10 is a fragmentary isometric view of the device showing the lip like portion on the locking arm in a positive stop position holding the locking arm in an open position on the vent window.

Still another embodiment of the subject invention is shown by FIG. 10. As locking arm 17 is rotated clockwise about bolt 20, the lip like portion 42 hits the bottom edge portion 45 of body 19. The configuration of lip like portion 42 in conjunction with the configuration of body 19 is such that when lip like portion 42 is in abutment with the bottom edge portion 45 of body 19, a "positive stop" is obtained to the clockwise rotational movement of locking arm 17. At this "positive stop" position, locking arm 17 is prevented from coming into abutment with window frame bar 15 and vent window 13 is free to open and close without any interference.

While certain embodiments of my invention have been shown and described, it is understood that it is capable of many modifications. Changes, therefore, in the construction and arrangement may be made without departing from the spirit and scope of the invention.

I claim:

1. A firm closure and locking device for a vent window pivotally mounted and adjacent a rigid member, said locking device comprising in combination a body with a first end portion substantially U-shaped in configuration for adaptability in circumscribing an edge portion of said vent window, said U-shaped first end portion comprising two sides substantially parallel to each other and interconnected by a third side, said body comprising a second offset end portion substantially parallel to said substantially parallel sides of said U-shaped first end portion, a pivot element projecting from said second offset end portion of said body, a locking arm comprising a substantially flat plane surface extending from a first longitudinal end of said locking arm to the second opposite longitudinal end of said locking arm, said locking arm pivotally mounted to said body by means of said pivot element, a pressure bearing device affixed to the projecting end portion of said pivot element, said locking arm positioned between said body and said pressure bearing device, said locking arm rotatable about said pivot element when said pressure bearing device is adapted to exert no pressure, said substantially flat plane surface of said locking arm adapted to rotate into a position in abutment with said adjacent rigid member when said vent window is in a substantially closed position and said body is affixed to said edge portion of said vent window adjacent said rigid member by means of said U-shaped first end portion of said body circumscribing said edge portion of said vent window, said substantially flat plane surface of said locking arm securely locked in said abutting position simultaneously against both said adjacent rigid member and said body as said pressure bearing device is adapted to exert pressure against said locking arm, said substanially flat plane surface of said locking arm securely adapted in said abutting position against both said adjacent rigid member and said body in conjunction with said U-shaped first end portion affixed to said edge portion of said vent window preventing said vent window from pivotal movement thereby firmly closing and locking said vent window in said closed position.

2. A vent window firm closure and locking device as claimed by claim 1, said pivot element projecting from said body comprising a screw like member, said pressure bearing device comprising a handle member comprising an internal threaded receptacle portion with threads compatible to the threads of said screw like member, said handle member being threadedly engaged onto said screw like member with said locking arm intermediate said handle member and said body, said handle member adapted to rotate about said screw like member in a first direction bringing said handle member closer to said body by means of said threaded engagement and adapted to rotate about said screw like member in a second opposite direction increasing the distance of said handle member from said body, rotation of said handle member in said first direction applying pressure by said handle member against said adjacent locking arm locking said intermediate locking arm in a fixed position and in simultaneous abutment between said second offset end portion of said body and said handle member, rotation of said handle member in said second opposite direction adapted to release pressure from said locking arm enabling said locking arm to rotate about said screw like member, said threaded engagement configuration adapted to allow said locking arm relative inward and outward movement with respect to said body when said handle member is adapted to increase or decrease its distance from said body, said locking arm inward and outward movement adapted to provide flexibility in clearing the edge portion of said adjacent rigid member and enabling abutment of said substantially flat plane surface of said locking arm with a side portion of said adjacent rigid member, said handle member adapted to increase pressure against said locking arm with said substantially flat plane surface of said locking arm in simultaneous abutting configuration with said adjacent rigid member and said second offset end portion of said body drawing said vent window into tight closure.

3. A vent window firm closure and locking device as claimed by claim 1, said locking arm comprising a substantially flat plane inner surface extending from a first longitudinal end of said locking arm to the second opposite longitudinal end of said locking arm and a substantially flat plane outer surface extending from a first longitudinal end of said locking arm to the second opposite longitudinal end of said locking arm, said inner surface in abutment with said second offset portion of said body of said locking device with simultaneous abutment against said adjacent rigid member, said outer surface of said locking arm in abutment with said handle member, said handle member adapted to apply pressure on said substantially flat plane outer surface of said locking arm, said substantially flat plane inner surface of said locking arm transmitting said applied pressure simultaneously to said abutting second offset end portion of said body and said abutting adjacent rigid member, respectively, thereby drawing said U-shaped first end portion towards said adjacent rigid member and said vent window affixed to said U-shaped first end portion into a tightly closed position.

4. A firm closure and locking device for a vent window pivotally mounted and adjacent a rigid member, said locking device comprising in combination a body with a first end portion generally U-shaped in configuration, said U-shaped first end portion comprising two sides substantially parallel to each other and interconnected by a third side, said U-shaped first end portion configured for adaptability in circumscribing an edge portion of said vent window, a pivot element projecting from a second offset end portion of said body substantially parallel to the substantially parallel sides of said U-shaped first end portion, a locking arm comprising a substantially flat plane surface extending from a first longitudinal end of said locking arm to the second opposite longitudinal end of said locking arm, said locking arm pivotally mounted to said body by means of said pivot element, a pressure bearing device affixed to the projecting end portion of said pivot element, a lip like element laterally protruding from a longitudinal edge of said locking arm, said locking arm adapted to rotate about said pivot element on said second offset end portion of said body into a position in abutment with said adjacent rigid member when said vent window is in a substantially closed position and said body is affixed to said edge portion of said vent window adjacent said rigid member by means of said U-shaped first end portion of said body circumscribing said edge portion of said vent window, said substantially flat plane surface of said locking arm rotatable in a first direction into a position of abutment with said adjacent rigid member with said lip like element protruding from said locking arm adapted to engaged said body of said firm closure and locking device, said engagement of said lip like element with said body forming a positive stop adapted to hold said locking arm from further rotational movement in said first direction with said substantially flat plane surface of said locking arm aligned in a position of simultaneous abutment against said adjacent rigid member and said second offset end portion of said body, said pressure bearing device adapted to exert pressure against said locking arm, said locking arm securely locked in said abutting position against said adjacent rigid member in conjunction with said U-shaped first end portion affixed to said edge portion of said vent window preventing said vent window from pivotal movement thereby firmly locking said vent window in said closed position.

5. A vent window firm closure and locking device as claimed by claim 4, said locking arm adapted to rotate in a second opposite direction out of abutment with said adjacent rigid member, said locking arm rotatable in said second opposite direction and adapted to remain out of abutment with said adjacent rigid member by means of said lip like element protruding from said locking arm, said lip like element configured to abut said body of said firm closure and locking device to form a positive stop adapted to prevent said locking arm from additional rotational movement required for abutment of said substantially flat plane surface of said locking arm with said adjacent rigid member thereby allowing said vent window to freely open and close without interference by said locking arm with said adjacent rigid member.

* * * * *